United States Patent [19]

Marchetti et al.

[11] 4,238,061

[45] Dec. 9, 1980

[54] SOCKS OR STOCKINGS WEAR-HELPING UTENSIL

[75] Inventors: Luigi Marchetti; Sergio Zaglio, both of Castiglione delle Stiviere, Italy

[73] Assignee: I.B. Internazionale Brevetti s.r.l., Castiglione delle Stiviere, Italy

[21] Appl. No.: 37,913

[22] Filed: May 9, 1979

[30] Foreign Application Priority Data

May 15, 1978 [IT] Italy ..... 23410 A/78

[51] Int. Cl.[3] ..... A47J 51/06

[52] U.S. Cl. ..... 223/111; 294/19 R

[58] Field of Search ..... 294/19 R, 24, 15, 17, 294/19 A, 22, 23 R, 53.5; 2/303, 335; 223/111, 112

[56] References Cited

U.S. PATENT DOCUMENTS

| | | | |
|---|---|---|---|
| 2,894,669 | 7/1959 | Silken | 223/111 |
| 3,227,335 | 1/1966 | Minnema et al. | 223/111 |
| 3,883,052 | 5/1975 | Wilson | 223/111 |
| 4,130,226 | 12/1978 | Farrell | 223/111 |

*Primary Examiner*—James B. Marbert

*Attorney, Agent, or Firm*—Shlesinger, Fitzsimmons & Shlesinger

[57] ABSTRACT

To help disabled people to put on socks or stockings without being compelled to lean forward or to bend down, a utensil is disclosed which comprises an elongate rod carrying at one end a round half-shell on which the socks or stockings piece rolled up in the upturned position, the shell being rotatable about a pivot carried by said rod. Once the wearer has slipped his toe tip in the socks tip, he thrusts his foot on into the socks piece and this is gradually unrolled from the shell: by slightly pulling the rod up as the heel area is reached, the socks piece continues to be unrolled and fits the wearer's leg gradually. The reverse manipulation is adopted for pulling the socks out.

3 Claims, 6 Drawing Figures

SOCKS OR STOCKINGS WEAR-HELPING UTENSIL

This invention relates to manual utensil which is intended to be used by people having problems when bending down for putting on socks or stockings.

It is known that, for putting on a stockings piece or a socks piece, it is necessary, at the outset, to bend the body until reaching the foot on which the stockings piece or the socks piece is to be worn.

Obviously, this is no problem for people of normal physical fitness, but this is not true for those who, for one reason or another (arthritic ailments, sciatica, lumbago, obesity, plaster casings and so forth) are unable to bend themselves to the requested extent. Under these circumstances, the only possible approach is to resort to the help of other people, that which is often a reason of embarrassment and trouble both for the one who is asking for help and for the one who is requested of such a help.

An object of the present invention is to provide a manually operable utensil which enables people having problems of bending their body down, to put on, readily and quickly, stockings or socks pieces of any type and length (that is, with the exclusion of panty hoses) without necessitating help from anybody.

According to the invention, this object is achieved by means of a utensil which is characterized in that it comprises an elongate rod carrying at one end a substantially semicylindrical shell which is rotatable about an axis perpendicular both to its own axis and tc the axis of the rod.

The semicylindrical shell is obviously intended to work as a supporting member for the socks or stockings piece, the latter being placed on such a shell upturned. With the shell initially oriented with its own axis perpendicular to the axis of the supporting rod, it becomes thus possible, while the rod is grasped at the other end, to slip the tip of the toe into the upturned socks or stockings piece, so that it becomes possible to start the slipping of the piece in the correct direction from the shell on which it had been placed. Once the heel area is reached, it is the socks or stocking piece itself which, reacting to a pulling action impressed by the supporting rod, causes the swing of the shell until the latter becomes arranged parallely with its axis, to the supporting rod axis. By lifting the latter farther up, the stocking piece is completely withdrawn from the shell and lifted along the limb to the level determined by the length of the socks or stocking piece.

Inasmuch as all of these operations can be carried out by the wearer himself without bending or leaning forward, but by merely manipulating the utensil in a convenient position through the proximal end of the rod, it is apparent that the utensil according to the invention is capable of solving the present problems of people who have difficulty in leaning forward their body, so that those people become fully independent, in the same way as people who enjoy a perfect physical fitness.

Preferably, the proximal end of the supporting rod for the swingable shell has a grasping handle much in the shape of a goose neck. This circumstance makes it possible to use the utensil in the reversed position also for slipping out the stockings or socks, an operation which is performed by using the goose-neck end very much in the same way as the finger of one hand.

Still preferably, the supporting rod is sectioned in more dismemberable pieces. This fact makes it possible to dismember the rod, and thus the utensil, in a number of component parts which can be located in a suitcasen or any similar carrier. It become thus possible for anyone to carry on himself the utensil on the occasions of voyages, journeys, short or long stays out of home and so on.

In order to afford a better understanding of the invention, a possible embodiment of the utensil in question is described by way of nonlimiting example in the accompanying drawings, wherein:

FIG. 1 shows a utensil according to the invention in perspective view and in readiness to receive a stockings piece to be put on.

Figure 1:
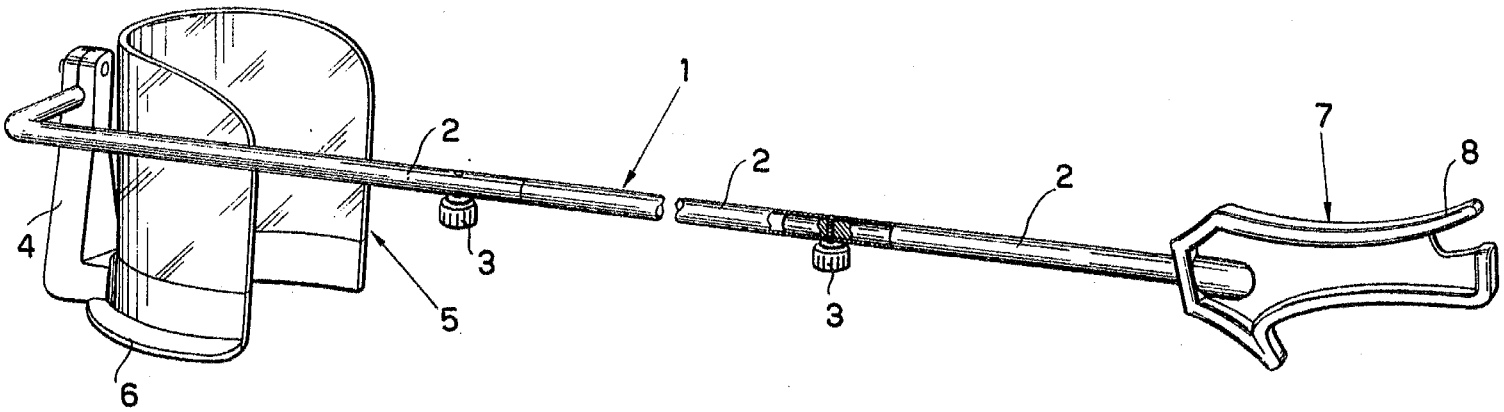

The utensil shown in FIG. 1 comprises an elongate cylindrical rod 1, which can be dismembered in a number of pieces, such as 2, which are normally united together by screw means such as 3. One end of the rod 1 is bent through 90 degrees and acts as a pivotal pin (when a stress is impressed to the L-piece) for an L-piece 4. Piece 4 has a substantially semicylindrical shell 5, fastened thereto, which is fitted with an end flange 6. The opposite end of the rod 1, conversely, carried a manipulating handle 7, the latter having a goose-neck shaped portion 8.

Figure 2:
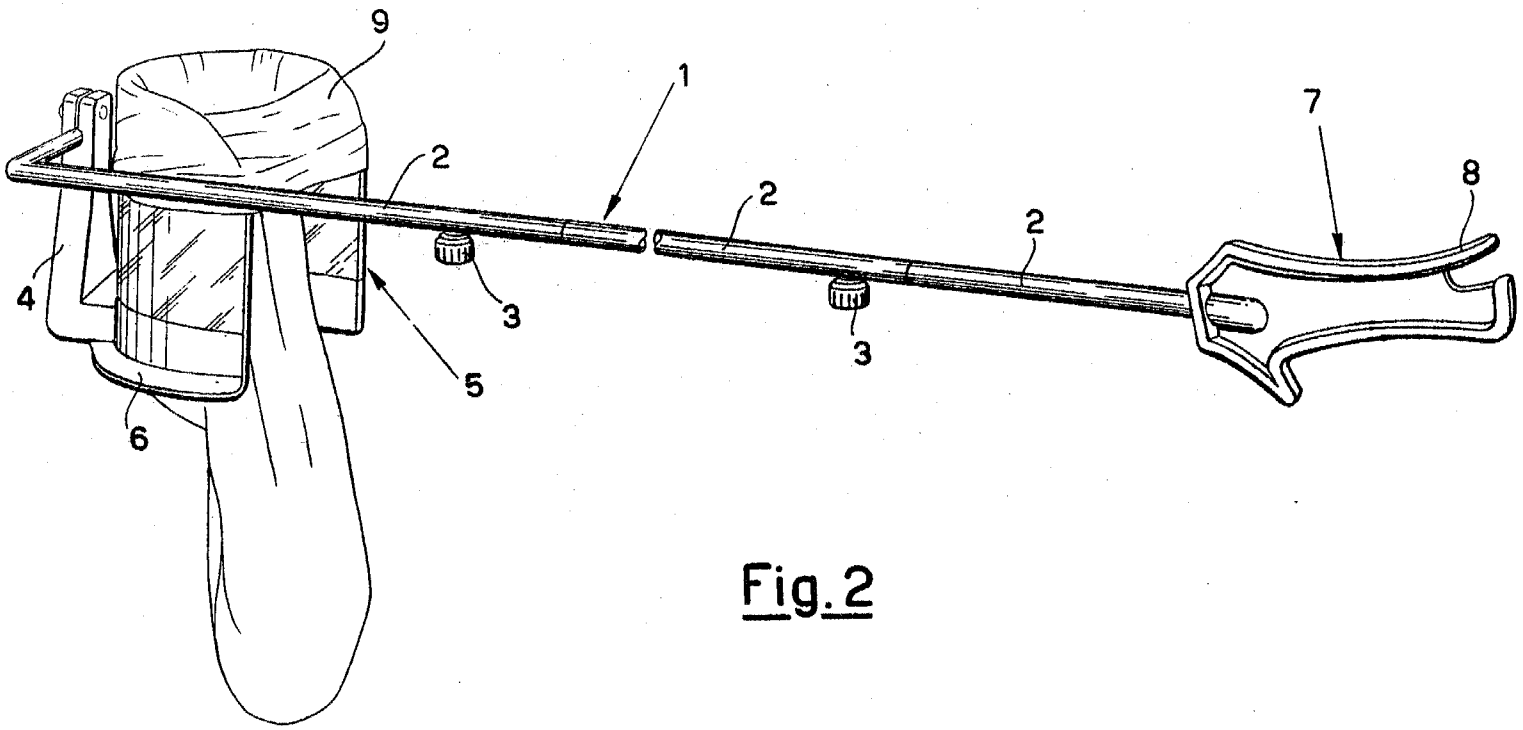
FIG. 2 shows the same utensil when a socks piece is being placed thereon in position.
Figure 3:
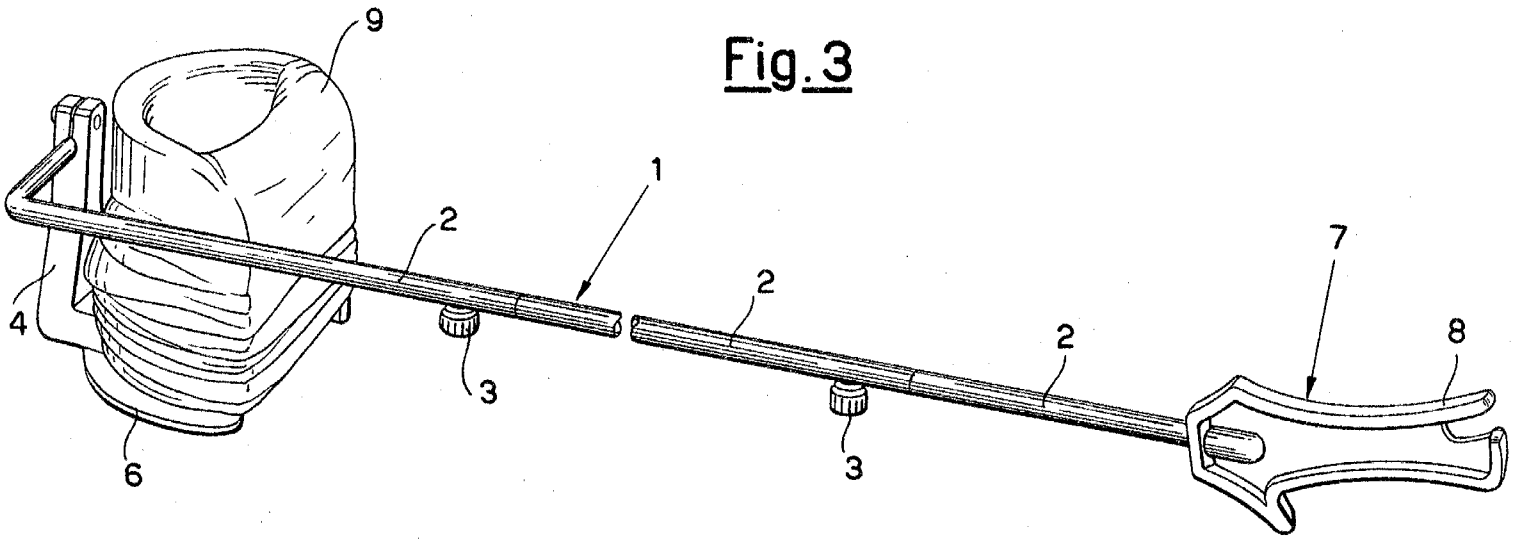
FIG. 3 shows the same utensil with the socks piece mounted on it.

To use the utensil, the rotatable shell 5 is placed, at the outset, with its axis perpendicular to that of the rod 1 and the flange 6 is placed to rest on any resting plane, whereafter the stockings or socks piece (a socks piece in the example shown, indicated at 9) is slipped, upturned, on the shell, care having previously been taken to align the stockings piece correctly and symmetrically relative to the central generating line of the semicylindrical shell 5, as shown in FIG. 2. This operation is continued until the entire socks piece has been placed upturned about the shell 5, the only exception being the stocking tip which is placed loosely to drop in the interior of the shell, as shown in FIG. 3.

Figure 4:
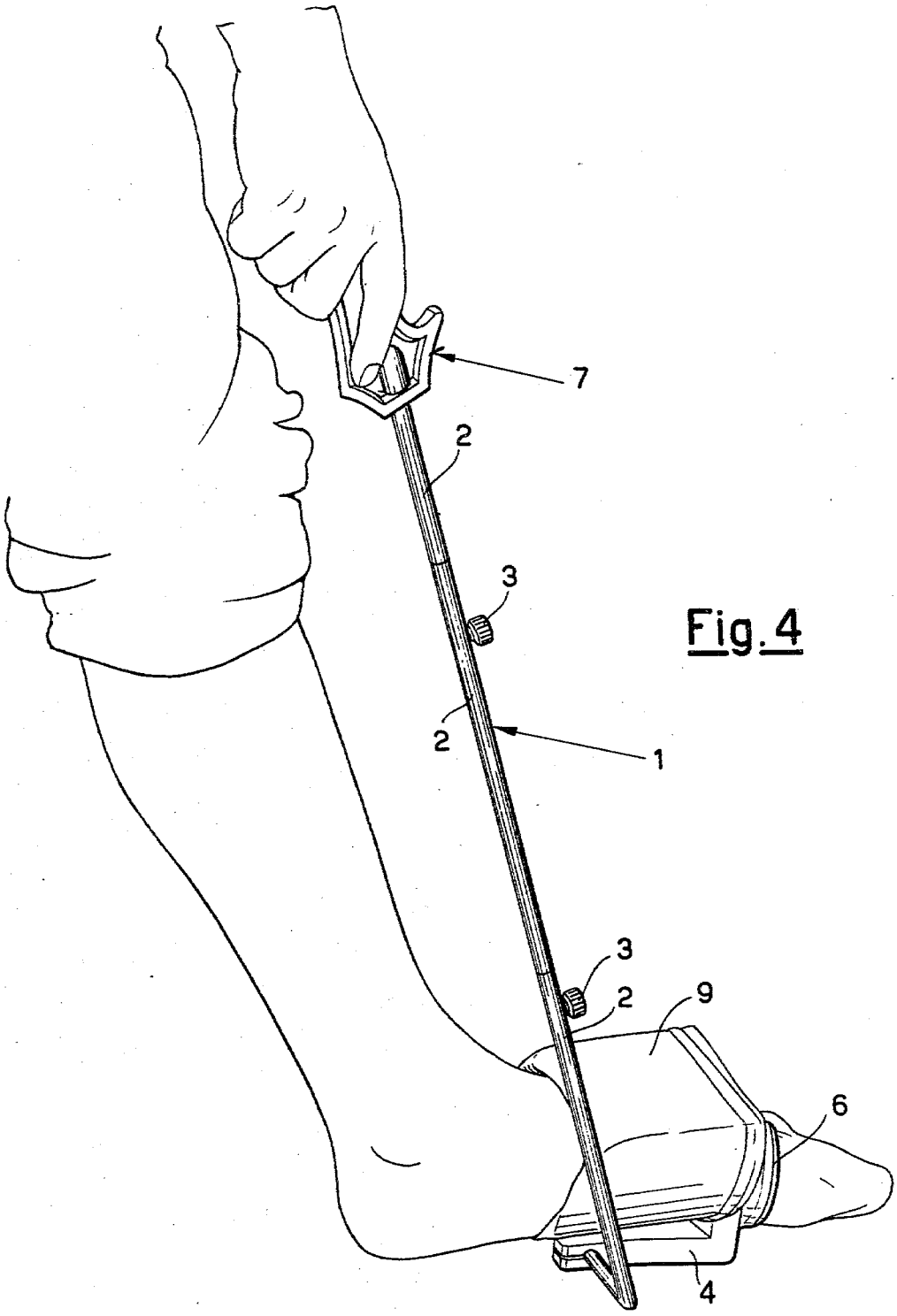
FIGS. 4, 5 and 6 show as many stages of use of the utensil for putting on the socks piece placed thereon.

Once that the socks piece has been so positioned, the wearer grasps with his hand the utensil by the handle 7 and, with the shell 5 having still its axis substantially perpendicular to that of the rod 1, slips the tip of the toe in the corresponding portion of the socks piece 9 as positioned on the shell 5, as viewed in FIG. 4.

As the wearer continues to push his foot into the socks the latter is gradually slipped out of the shell 5 and gradually fits the wearer's foot.

Figure 5:
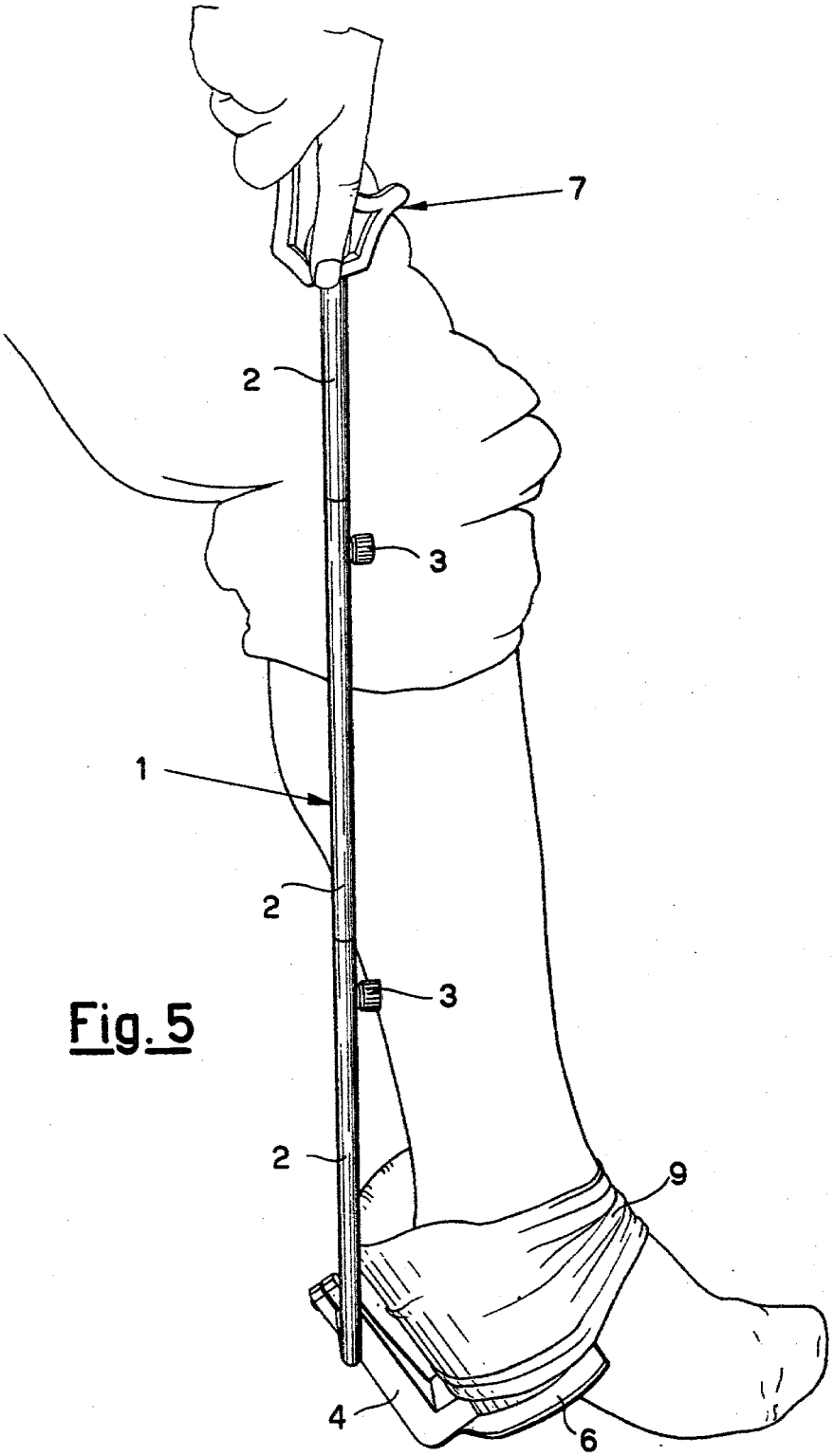

As the heel area is attained, (FIG. 5), the wearer slightly pulls up the supporting rod 1, thus causing, via the reaction of the socks piece, the swing of the shell 5 towards a final position in which the shell itself has its axis substantially parallel to that of the rod 1.

Figure 6:
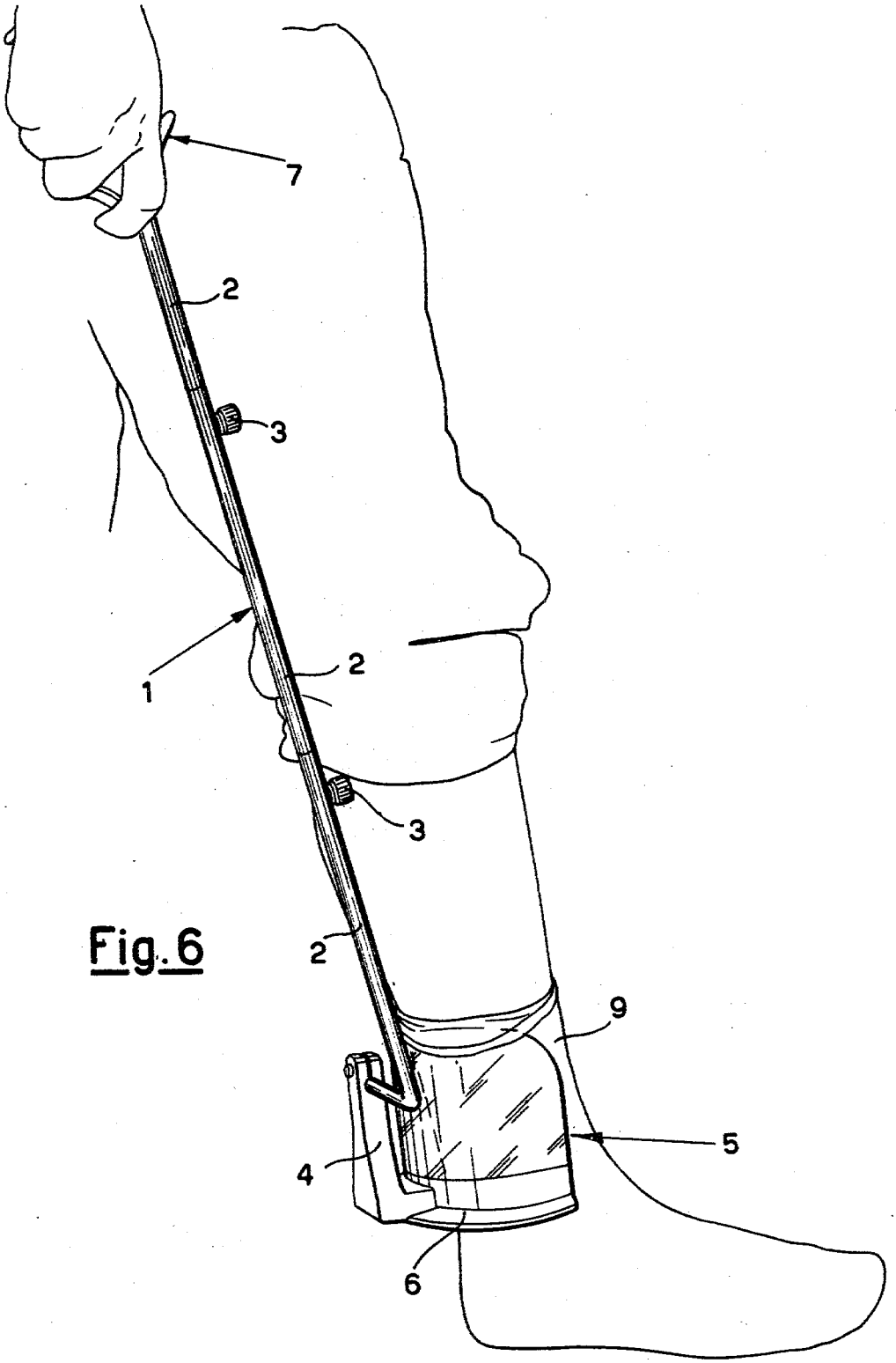

At this stage, the farther pull of the supporting rod 1 causes the socks piece to become completely clear of the shell 5 and fitted around the wearer's leg, as viewed in FIG. 6.

To slip the socks piece out, it is enough to reverse the utensil and to insert the goose-neck end 8 of the handle 7 between the leng and the socks piece and to push down the utensil to the necessary extent.

It is apparent that none of the operations described above requires of the wearer to bend down or lean forward so that any problems the wearer might have under this respect are done away with.

I claim:

1. A manually operable utensil for putting on socks or stockings, characterized in that it comprises an elongate rod carrying at one end thereof a substantially semi-cylindrical shell disposed to be held by said rod in a starting position in which the axis of said shell is positioned transversely of the axis of said rod, and wherein the open end of a sock or stocking is supported on the shell for engagement by the foot of the person by whom it is to be worn, and means pivotally mounting said shell on said one end of the rod automatically to be swung about an axis perpendicular to its own axis and to the axis of said rod from said starting position to a final position in which its axis is disposed substantially parallel to said rod, when the wearer's foot is inserted into the sock or stocking, and said rod is drawn manually upwardly.

2. A utensil according to claim 1, characterized in that said elongate rod has, at the end opposite to that carrying said shell, a grasping handle having a gooseneck shaped portion.

3. A utensil according to claim 2, characterized in that said elongate rod is divided into a number of pieces releasably attached to each other.

* * * * *